US006511294B1

(12) United States Patent
Mielke et al.

(10) Patent No.: US 6,511,294 B1
(45) Date of Patent: Jan. 28, 2003

(54) REDUCED-STRESS COMPRESSOR BLISK FLOWPATH

(75) Inventors: Mark J. Mielke, Blanchester, OH (US); James E. Rhoda, Mason, OH (US); David E. Bulman, Cincinnati, OH (US); Craig P. Burns, Mason, OH (US); Paul M. Smith, Loveland, OH (US); Daniel G. Suffoletta, Cincinnati, OH (US); Steven M. Ballman, West Chester, OH (US); Richard P. Zylka, Cincinnati, OH (US); Lawrence J. Egan, Mason, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/405,308

(22) Filed: Sep. 23, 1999

(51) Int. Cl.[7] ..... F01D 5/22
(52) U.S. Cl. ..... 416/193 A; 416/201 R
(58) Field of Search ..... 416/193 A, 193 R, 416/248, 219 R

(56) References Cited

U.S. PATENT DOCUMENTS

| | | | | |
|---|---|---|---|---|
| 1,793,468 A | | 2/1931 | Densmore | |
| 2,415,380 A | | 2/1947 | Weber | |
| 2,429,324 A | | 10/1947 | Meisser | |
| 2,735,612 A | | 2/1956 | Hausmann | |
| 2,790,620 A | | 4/1957 | Rankin | |
| 2,918,254 A | | 12/1959 | Hausammann | |
| 3,095,180 A | | 6/1963 | Clarke et al. | 253/77 |
| 3,389,889 A | | 6/1968 | Penny | 253/39.15 |
| 3,481,531 A | | 12/1969 | Mac Arthuer et al. | 230/134 |
| 3,529,631 A | | 9/1970 | Riollet | |
| 3,584,969 A | | 6/1971 | Aiki et al. | |
| 3,661,475 A | | 5/1972 | Anderson et al. | |
| 3,730,644 A | | 5/1973 | Jubb | 416/95 |
| 3,888,602 A | * | 6/1975 | Nichols et al. | 416/198 A |
| 3,890,062 A | | 6/1975 | Hendrix et al. | |
| 3,891,351 A | * | 6/1975 | Norbut | 416/219 R |
| 3,897,171 A | * | 7/1975 | Stahl | 416/213 R |
| 3,927,952 A | | 12/1975 | Kirby | |
| 3,951,611 A | | 4/1976 | Morrill | |
| 4,062,638 A | * | 12/1977 | Hall, Jr. | 416/244 A |
| 4,135,857 A | | 1/1979 | Pannone et al. | |
| 4,188,169 A | | 2/1980 | Mowill | |
| 4,335,997 A | | 6/1982 | Ewing et al. | |
| 4,420,288 A | | 12/1983 | Bischoff | |
| 4,465,433 A | | 8/1984 | Bischoff | 416/233 A |
| 4,587,700 A | | 5/1986 | Curbishley et al. | |
| 4,659,288 A | | 4/1987 | Clark et al. | |
| 4,671,739 A | | 6/1987 | Read et al. | |
| 4,704,066 A | | 11/1987 | Weissbacher | |
| 4,866,985 A | | 9/1989 | Futrell, II | |
| 4,884,948 A | | 12/1989 | Sikorski | |
| 5,007,801 A | | 4/1991 | Hopfensperger et al. | |
| 5,018,271 A | | 5/1991 | Bailey et al. | |
| 5,061,154 A | | 10/1991 | Kington | |

(List continued on next page.)

FOREIGN PATENT DOCUMENTS

| | | |
|---|---|---|
| DE | 191354 | 8/1957 |
| RU | 756083 | 8/1980 |

*Primary Examiner*—John E. Ryznic
(74) *Attorney, Agent, or Firm*—Rodney M. Young; Armstrong Teasdale LLP

(57) ABSTRACT

A gas turbine engine rotor assembly including a rotor having a radially outer rim with an outer surface shaped to reduce circumferential rim stress concentration between each blade and the rim. Additionally, the shape of the outer surface directs air flow away from an interface between a blade and the rim to reduce aerodynamic performance losses between the rim and blades. In an exemplary embodiment, the outer surface of the rim has a concave shape between adjacent blades with apexes located at interfaces between the blades and the rim.

20 Claims, 3 Drawing Sheets

U.S. PATENT DOCUMENTS 5,104,290 A * 4/1992 Catlow ..... 415/115
5,215,439 A 6/1993 Jansen et al. ..... 416/183
5,244,345 A 9/1993 Curtis
5,292,385 A 3/1994 Kington ..... 148/404
5,310,318 A * 5/1994 Lammas et al. ..... 416/219 R
5,397,215 A 3/1995 Spear et al.
5,466,123 A 11/1995 Rose
5,554,004 A 9/1996 Stewart
5,735,673 A 4/1998 Matheny et al.
5,775,878 A 7/1998 Maumus et al.
5,988,980 A * 11/1999 Busbey et al. ..... 416/193 R

* cited by examiner

REDUCED-STRESS COMPRESSOR BLISK FLOWPATH

GOVERNMENT RIGHTS STATEMENT

The United States Government has rights in this invention pursuant to Contract No. N00019-96-C-0176 awarded by the JSF Program Office (currently administered by the U.S. Navy).

BACKGROUND OF THE INVENTION

This invention relates generally to gas turbine engines and, more specifically, to a flowpath through a compressor rotor.

A gas turbine engine typically includes a multi-stage axial compressor with a number of compressor blade or airfoil rows extending radially outwardly from a common annular rim. The outer surface of the rotor rim typically defines the radially inner flowpath surface of the compressor as air is compressed from stage to stage. Centrifugal forces generated by the rotating blades are carried by portions of the rim directly below the blades. The centrifugal forces generate circumferential rim stress concentration between the rim and the blades.

Additionally, a thermal gradient between the annular rim and compressor bore during transient operations generates thermal stress which adversely impacts a low cycle fatigue (LCF) life of the rim. In addition, and in a blisk intergrally bladed disk configuration, the rim is exposed directly to the flowpath air, which increases the thermal gradient and the rim stress. Also, blade roots generate local forces which further increase rim stress.

BRIEF SUMMARY OF THE INVENTION

The present invention, in one aspect, is a gas turbine engine rotor assembly including a rotor having a radially outer rim with an outer surface shaped to reduce rim stress between the outer rim and a blade and to direct air flow away from an interface between a blade and the rim, thus reducing aerodynamic performance losses. More particularly, and in an exemplary embodiment, the disk includes a radially inner hub, and a web extending between the hub and the rim, and a plurality of circumferentially spaced apart rotor blades extending radially outwardly from the rim. In the exemplary embodiment, the outer surface of the rim has a concave shape between adjacent blades with apexes located at interfaces between the blades and the rim.

The outer surface of the rotor rim defines the radially inner flowpath surface of the compressor as air is compressed from stage to stage. By providing that the rim outer surface has a concave shape between adjacent blades, rim stress between the blade and the rim is reduced. Additionally, the concave shape generally directs airflow away from immediately adjacent to the blade/rim interface and more towards a center of the flowpath between the adjacent blades. As a result, aerodynamic performance losses are reduced. Reducing such rim stress facilitates increasing the LCF life of the rim.

DETAILED DESCRIPTION OF THE INVENTION

Figure 1:
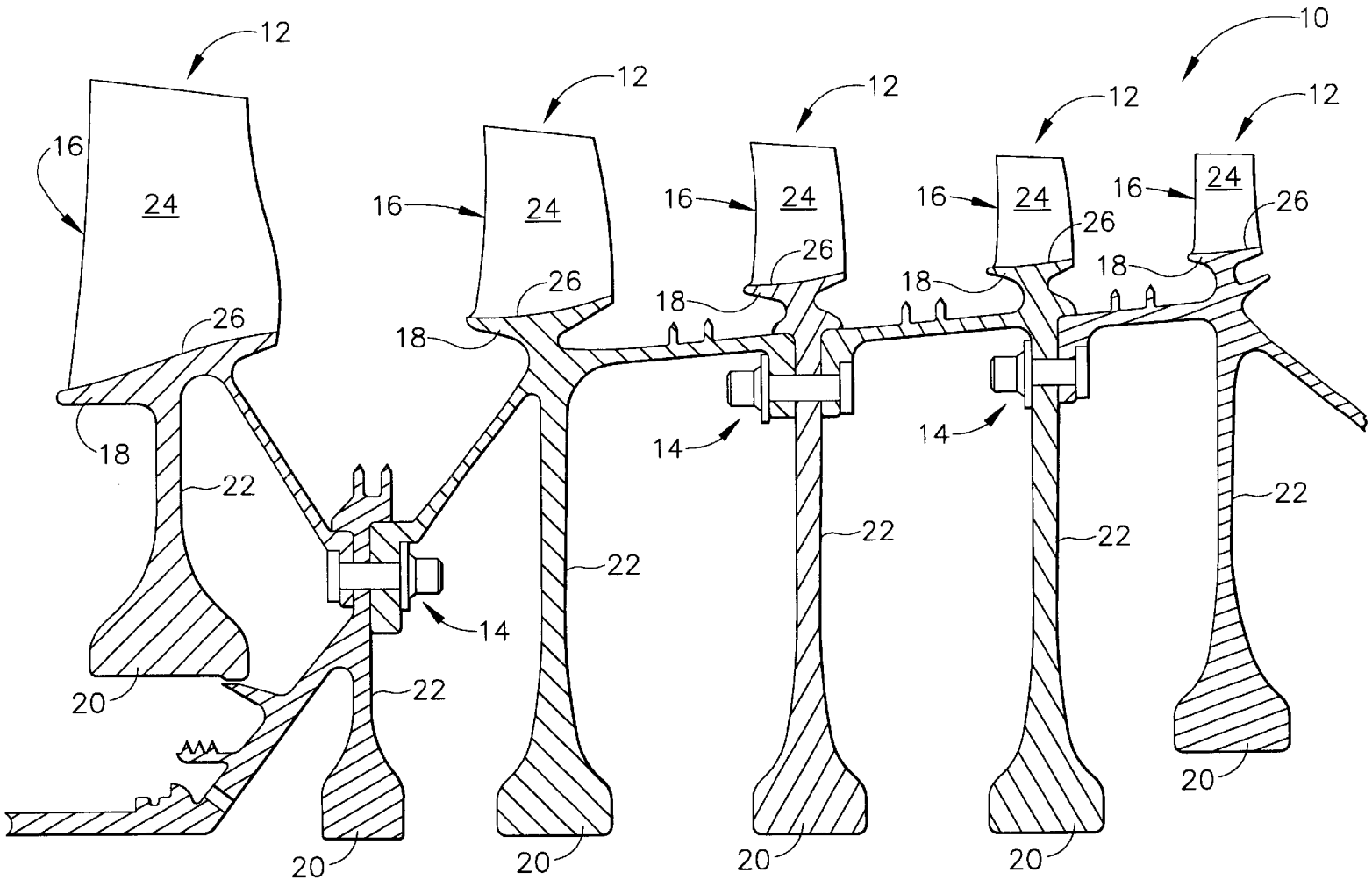
FIG. 1 is a schematic illustration of a portion of a compressor rotor assembly.

FIG. 1 is a schematic illustration of a portion of a compressor rotor assembly 10. Rotor assembly 10 includes rotors 12 joined together by couplings 14 coaxially about an axial centerline axis (not shown). Each rotor 12 is formed by one or more blisks 16, and each blisk 16 includes a radially outer rim 18, a radially inner hub 20, and an integral web 22 extending radially therebetween. An interior area within rim 18 sometimes is referred to as a compressor bore. Each blisk 16 also includes a plurality of blades 24 extending radially outwardly from rim 18. Blades 24, in the embodiment illustrated in FIG. 1, are integrally joined with respective rims 18. Alternatively, and for at least one of the stages, each rotor blade may be removably joined to the rims in a known manner using blade dovetails which mount in complementary slots in the respective rim.

In the exemplary embodiment illustrated in FIG. 1, five rotor stages are illustrated with rotor blades 24 configured for cooperating with a motive or working fluid, such as air. In the exemplary embodiment illustrated in FIG. 1, rotor assembly 10 is a compressor of a gas turbine engine, with rotor blades 24 configured for suitably compressing the motive fluid air in succeeding stages. Outer surfaces 26 of rotor rims 18 define the radially inner flowpath surface of the compressor as air is compressed from stage to stage.

Blades 24 rotate about the axial centerline axis up to a specific maximum design rotational speed, and generate centrifugal loads in the rotating components. Centrifugal forces generated by rotating blades 24 are carried by portions of rims 18 directly below each blade 24.

Figure 2:
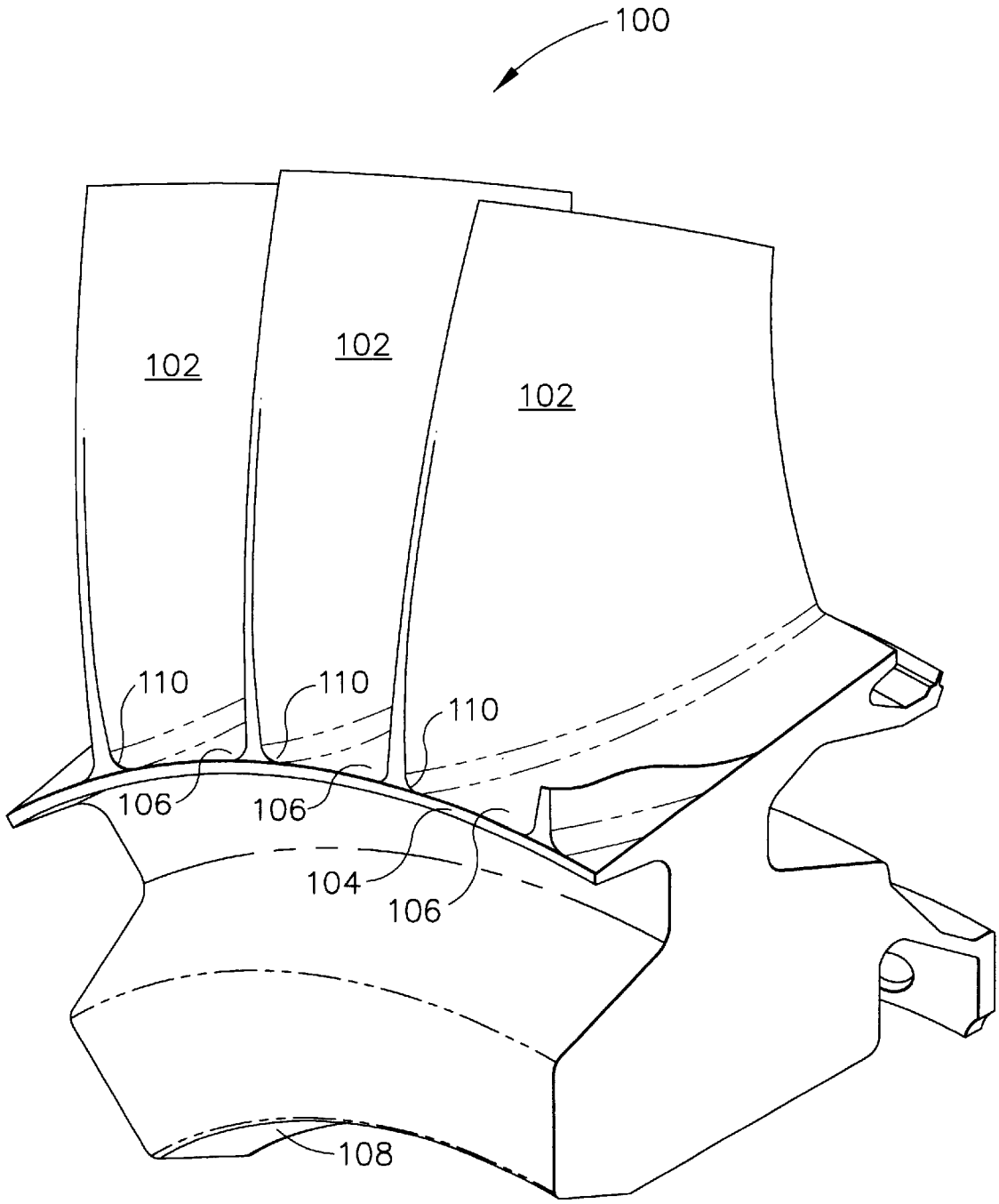
FIG. 2 is a forward view of a portion of a known compressor stage rotor assembly.

FIG. 2 is a forward view of a portion of a known compressor stage rotor 100. Rotor 100 includes a plurality of blades 102 extending from a rim 104. A radially outer surface 106 of rim 104 defines the radially inner flowpath, and air flows between adjacent blades 102. A thermal gradient between annular rim 104 and compressor bore 108 particularly during transient operations generates thermal stress which adversely impacts the low cycle fatigue (LCF) life of rim 104. In addition, and in a blisk configuration as described in connection with FIG. 1, rim 104 is exposed directly to the flowpath air, which increases both the thermal gradient between rim 104 and bore 108. The increase in the thermal gradient increases the circumferential rim stress. Also, roots 110 of blades 102 generate local forces and stress concentrations which further increase rim stress.

In accordance with one embodiment of the present invention, the outer surface of the rim is configured to have a holly leaf shape. The respective blades are located at each apex of the holly leaf shaped rim, which provides the advantage that peak stresses in the rim are not located at the blade/rim intersection and stress concentrations are reduced which facilitates extending the LCF life of the rim.

Figure 3:
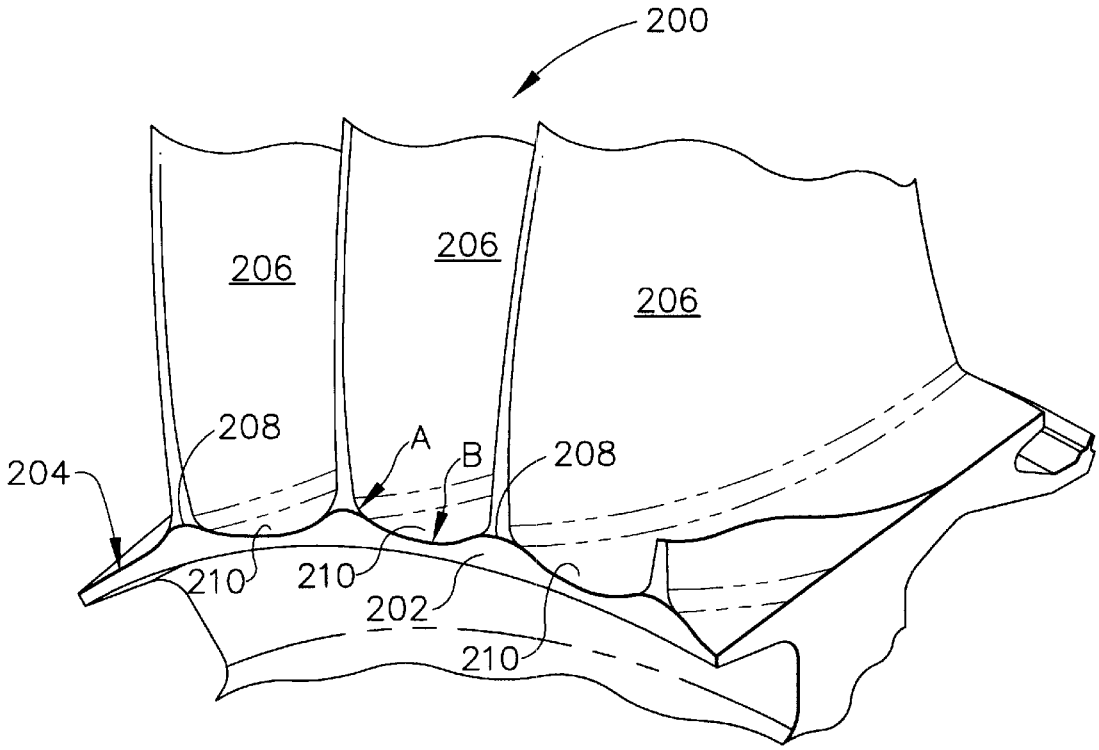
FIG. 3 is a forward view of a portion of a compressor stage rotor assembly in accordance with one embodiment of the present invention.

More particularly, FIG. 3 is a forward view of a portion of a compressor stage rotor 200 in accordance with one embodiment of the present invention. Rotor 200 includes a rim 202 having an outer rim surface 204. A plurality of blades 206 extend from rim surface 204. Rim surface 204 is holly leaf shaped in that surface 204 includes a plurality of apexes 208 separated by a concave shaped curved surface 210 between adjacent apexes 208.

The specific dimensions for rim surface 204 are selected based on the particular application and desired engine operation. In a first embodiment, the holly leaf shape is generated as a compound radius having a first radius A and a second radius B. First radius A is between approximately 0.04 inches and 0.5 inches and typically second radius B is approximately 2 to 10 times a distance between adjacent blades 206. In a second embodiment, first radius A is approximately 0.06 inches and a second radius B is approximately 2.0 inches.

Figure 4:
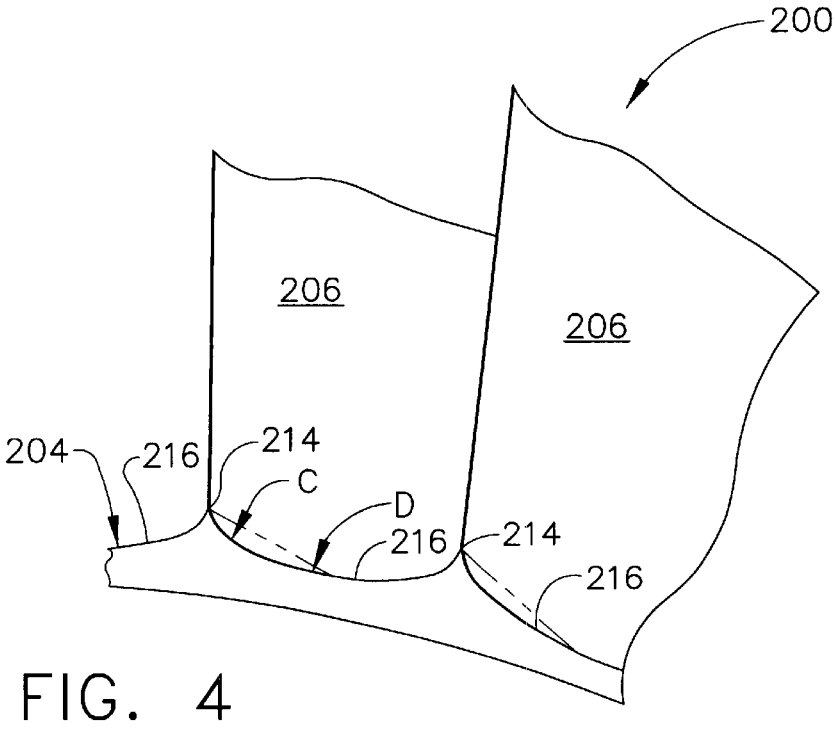
FIG. 4 is an aft view of a portion of the compressor stage rotor assembly shown in FIG. 3.

FIG. 4 is an aft view of a portion of the compressor stage rotor 200. Again, rim surface 204 is holly leaf shaped and includes a plurality of apexes 214 separated by a concave shaped curved surface 216 between adjacent apexes 214. In a first embodiment, the holly leaf shape is generated as a compound radius having a first radius C and a second radius D. First radius C is between approximately 0.04 inches and 0.5 inches and typically second radius D is approximately 2 to 10 times a distance between adjacent blades 206. In a second embodiment, first radius C is approximately 0.06 inches and second radius D is approximately 2.0 inches.

Rim surface 204 can be cast or machined to include the above-described shape. Alternatively, rim surface 204 can be formed after fabrication of rim 202 by, for example, securing blades 206 to rim 202 by fillet welds. Alternatively, blades 206 are secured to rim 202 by friction welds or other methods. Specifically, the welds can be made so that the desired shape for the flowpath between adjacent blades 206 is provided.

In operation, outer surface 204 of rotor rim 202 defines the radially inner flowpath surface of the compressor as air is compressed from stage to stage. By providing that outer surface 204 has a concave shape between adjacent blades 206, airflow is generally directed away from immediately adjacent the blade/rim interface and more towards a center of the flowpath between adjacent blades 206 which reduces aerodynamic performance losses. In addition, less circumferential rim stress concentration is generated between rim 202 and blades 206 at the location of the blade/rim interface. Reducing such at the interface facilitates extending the LCF life of rim 202.

Variations of the above-described embodiment are possible. For example, more complex shapes other than a concave compound radius shape can be selected for the rim outer surface between adjacent blades. Generally, the shape of the outer surface is selected to effectively reduce the circumferential rim stress concentration generated in the rim. Further, rather than fabricating the rim to have the desired shape or forming the shape using fillet welding, the blade itself can be fabricated to provide the desired shape at the location of the blade/rim interface. The shape of the inner surface of the rim can also be contoured to reduce rim stresses.

While the invention has been described in terms of various specific embodiments, those skilled in the art will recognize that the invention can be practiced with modification within the spirit and scope of the claims.

What is claimed is:

1. A method of reducing circumferential rim stress concentration in a gas turbine engine, the engine including a rotor including a radially outer rim, a radially inner hub, and a web extending therebetween, a plurality of circumferentially spaced apart rotor blades extending radially outwardly from the rim, said method comprising the step of:

providing an outer surface of the outer rim with a shape including a compound radius that defines at least one apex within the outer rim outer surface, and that reduces circumferential rim stress concentration between each of the blades and the rim; and operating the gas turbine engine such that airflow is directed over the outer rim outer surface.

2. A method in accordance with claim 1 wherein said step of providing an outer surface of the outer rim comprises the step of providing the outer surface of the outer rim with a concave compound radius.

3. A method in accordance with claim 2 wherein said step of providing the outer surface of the outer rim with a compound radius further comprises the step of providing a first radius between approximately 0.04 inches and 0.5 inches.

4. A method in accordance with claim 3 wherein said step of providing the outer surface of the outer rim with a compound radius further comprises the step of providing a second radius approximately 2 to 10 times a distance between said circumferentially spaced apart rotor blades.

5. A method in accordance with claim 1 wherein said step of providing an outer surface of the outer rim further comprises the step of casting a rim to include a rim surface having a shape including a compound radius.

6. A method in accordance with claim 1 wherein said step of providing an outer surface of the outer rim further comprises the step of machining a rim to produce a rim surface having a shape including a compound radius.

7. A method in accordance with claim 1 wherein said step of providing an outer surface of the outer rim further comprises the step of securing the blades to the rim by fillet welds or friction welds to produce a rim surface having a shape including a compound radius.

8. A method in accordance with claim 1 wherein the outer rim includes an inner surface, said method comprising the step of:

providing an inner surface of the outer rim with a shape that defines at least one apex within the outer rim, and that reduces circumferential rim stress concentration between each of the blades and the rim.

9. A gas turbine engine rotor assembly comprising a rotor comprising a radially outer rim, a radially inner hub, and a web extending therebetween, a plurality of circumferentially spaced apart rotor blades extending radially outwardly from said rim, an outer surface of said outer rim having a shape including a compound radius which defines at least one apex within said outer rim outer surface, and which reduces circumferential rim stress concentration between each of said blades and said rim.

10. A gas turbine engine rotor assembly in accordance with claim 9 wherein said outer rim surface has a circumferentially concave shape between adjacent blades.

11. A gas turbine engine in accordance with claim 9 wherein said rotor comprises a plurality of blisks.

12. A gas turbine engine in accordance with claim 9 wherein said outer rim shape directs air flow away from an interface between each of said blades and said rim.

13. A gas turbine engine in accordance with claim 9 wherein said outer surface of said outer rim comprises a compound radius.

14. A gas turbine engine in accordance with claim 13 wherein said compound radius comprises a first radius and a second radius, said first radius is between approximately 0.04 inches and 0.5 inches.

15. A gas turbine engine in accordance with claim 13 wherein said second radius is approximately 2 to 10 times a distance between said circumferentially spaced apart rotor blades.

16. A gas turbine engine rotor assembly comprising a first rotor and a second rotor, said first rotor coupled to said second rotor, at least one of said rotor comprising a radially outer rim, a radially inner hub, and a web extending therebetween, a plurality of circumferentially spaced apart rotor blades extending radially outwardly from said rim, an outer surface of said outer rim comprising a compound radius which reduces circumferential rim stress concentration between each of said blades and said rim.

17. A gas turbine engine rotor assembly in accordance with claim 16 wherein said outer rim surface of said one rotor has a concave shape between adjacent blades.

18. A gas turbine engine in accordance with claim 16 wherein said at least one of said rotor comprises a plurality of blisks.

19. A gas turbine engine in accordance with claim 16 wherein said outer surface of said outer rim comprises a first radius and a second radius.

20. A gas turbine engine in accordance with claim 19 wherein said first radius is between approximately 0.04 inches and 0.5 inches, said second radius is approximately 2 to 10 times a distance between said circumferentially spaced apart rotor blades.

* * * * *